US011268285B2

(12) United States Patent
Léger

(10) Patent No.: US 11,268,285 B2
(45) Date of Patent: Mar. 8, 2022

(54) RAILING ASSEMBLY

(71) Applicant: Imperial Manufacturing Group Inc., Richibucto (CA)

(72) Inventor: Sébastien Léger, Richibucto (CA)

( * ) Notice: Subject to any disclaimer, the term of this patent is extended or adjusted under 35 U.S.C. 154(b) by 227 days.

(21) Appl. No.: 16/509,704

(22) Filed: Jul. 12, 2019

(65) Prior Publication Data

US 2020/0018074 A1 Jan. 16, 2020

(30) Foreign Application Priority Data

Jul. 13, 2018 (CA) ..... CA 3011276

(51) Int. Cl.
*E04F 11/18* (2006.01)

(52) U.S. Cl.
CPC ... *E04F 11/1817* (2013.01); *E04F 2011/1821* (2013.01)

(58) Field of Classification Search
CPC . E04F 11/181; E04F 11/1817; E04F 11/1836; E04F 11/1848; E04F 2011/1821; E04F 2011/1823; E04F 2011/1825; E04F 2011/1827; E04H 17/1417; E04H 17/1426
USPC ..... 256/72
See application file for complete search history.

(56) References Cited

U.S. PATENT DOCUMENTS 3,506,243 A * 4/1970 Seiler ..... E04F 11/181 256/59
3,522,933 A * 8/1970 Braun ..... E04F 11/181 256/22
4,014,520 A * 3/1977 Walters ..... E04F 11/1817 256/22
4,050,828 A * 9/1977 Noro ..... E04F 11/1817 403/201
4,146,212 A * 3/1979 Lermer ..... E01D 19/103 256/68
4,953,830 A * 9/1990 Weaver, III ..... E04F 11/181 256/19
4,982,933 A * 1/1991 Schultz ..... E04H 17/1447 256/65.06
5,967,498 A * 10/1999 Junell ..... E04F 11/1812 256/19
6,254,064 B1 * 7/2001 Gibbs ..... E04H 17/00 256/21
8,104,744 B2 * 1/2012 Brownbill ..... E04H 17/1439 256/65.11

FOREIGN PATENT DOCUMENTS

CA 2638709 A1 * 2/2010 ..... E04H 17/1417
CH 322154 A * 6/1957 ..... E04F 11/181
(Continued)

*Primary Examiner* — Josh Skroupa
*Assistant Examiner* — Zachary A Hall
(74) *Attorney, Agent, or Firm* — Andrews Robichaud PC; Alessandro Colonnier

(57) ABSTRACT

The present disclosure provides for a railing assembly further comprised of a top and bottom rail separated by balusters. The balusters are connected to one another by means of spacers, which are in turn connected to both the top and bottom rails by means of a snap-fit connection. A method of assembly of the rail assembly is also disclosed, comprised of snap-fitting the spacers to the top and bottom rails and installing the balusters in between pairs of adjacent spacers, and repeating this process for a given length of the top and bottom rails.

11 Claims, 14 Drawing Sheets

(56) References Cited

FOREIGN PATENT DOCUMENTS

| | | | | | |
|---|---|---|---|---|---|
| EP | 0136387 | A1 | * | 4/1985 | ..... E04H 17/1417 |
| FR | 1478567 | A | * | 4/1967 | ..... E04F 11/181 |
| KR | 101655422 | B1 | * | 9/2016 | |
| KR | 101658203 | B1 | * | 9/2016 | |
| WO | WO-9967541 | A1 | * | 12/1999 | ..... E04F 11/181 |
| WO | WO-2005028776 | A1 | * | 3/2005 | ..... E04F 11/181 |
| WO | WO-2016090465 | A1 | * | 6/2016 | ..... F21S 4/28 |

* cited by examiner

RAILING ASSEMBLY

FIELD

The invention relates to the field of railings, and more specifically to an improved railing assembly with snap-fit connectors.

SUMMARY

The present disclosure provides for an improved railing assembly, comprising a top rail having a top connector positioned at a lower end thereof; at least one baluster having a first end and a second end, the first end of the at least one baluster positioned within the top rail, each end further comprised of a locking aperture; a bottom rail connected to the second end of the at least one baluster, the bottom rail having a bottom connector positioned at an upper end thereof; and at least four spacers, the first and second spacers connected the lower end of the top rail and separated by the at least one baluster, the third and fourth spacers connected to the upper end of the bottom rail and separated by the at least one baluster, wherein each of the at least four spacers is further comprised of a rod to penetrate and lock into the locking apertures of the at least one baluster.

The present disclosure also provides for a method of assembling a railing assembly, the steps comprising: a. applying a force onto a first spacer to snap-fit the first spacer onto a rail and inserting a first rod of the first spacer into a corresponding first locking aperture of a first baluster; b. applying a force onto a second spacer to snap-fit the second spacer onto an opposite rail and inserting a second rod of the second spacer into a corresponding second locking aperture of the first baluster; c. applying a force onto a third spacer to snap-fit the third spacer onto the rail and inserting a third rod of the third spacer into a corresponding third locking aperture of the first baluster; d. applying a force onto a fourth spacer to snap-fit the fourth spacer onto an opposite rail and inserting a fourth rod of the fourth spacer into a corresponding fourth locking aperture of the first baluster; and, e. repeating steps a)-d) for an n number of balusters for the length of the rail and opposite rail, wherein n is an integer having a value of at least 1.

BRIEF DESCRIPTION OF THE DRAWINGS

The following figures serve to illustrate various embodiments of features of the disclosure. These figures are illustrative and are not intended to be limiting.

DETAILED DESCRIPTION

The following embodiments are merely illustrative and are not intended to be limiting. It will be appreciated that various modifications and/or alterations to the embodiments described herein may be made without departing from the disclosure and any modifications and/or alterations are within the scope of the contemplated disclosure.

Figure 1:
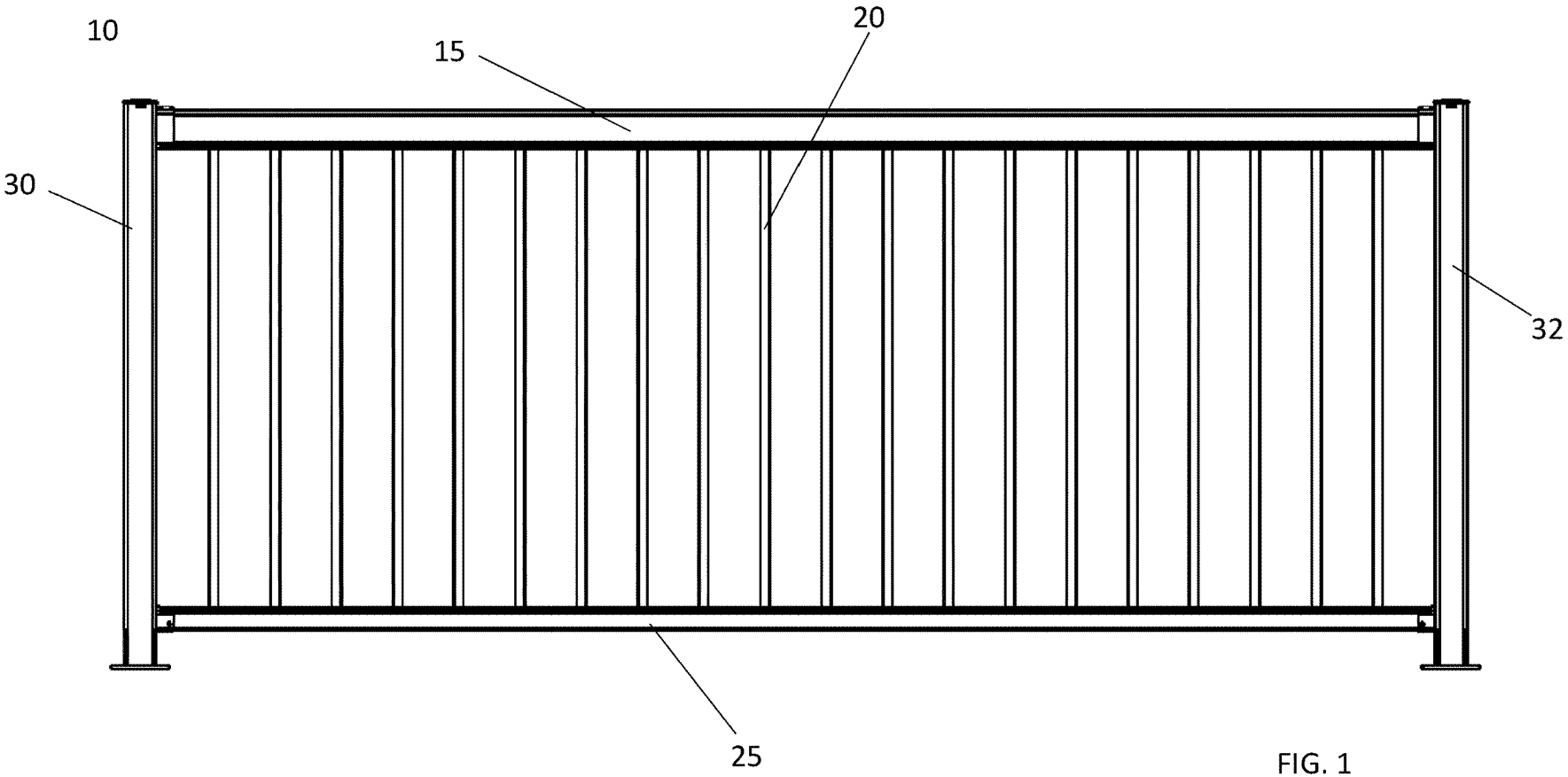
FIG. 1 is front view of a rail assembly according to an embodiment of the present disclosure.
Figure 2:
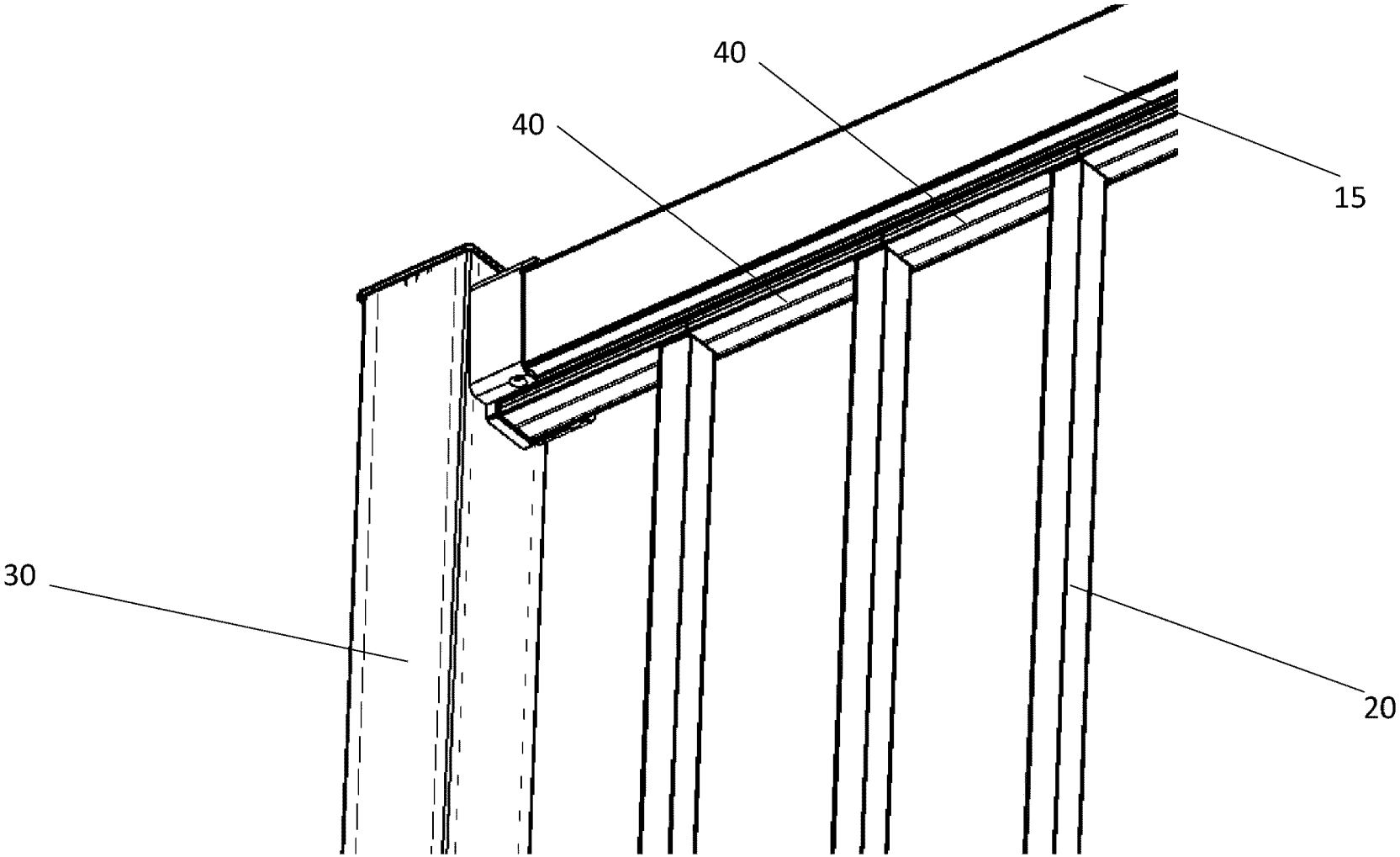
FIG. 2 is a perspective view of balusters connected to spacers and a top rail of the rail assembly, according to an embodiment of the present disclosure.
Figure 3:
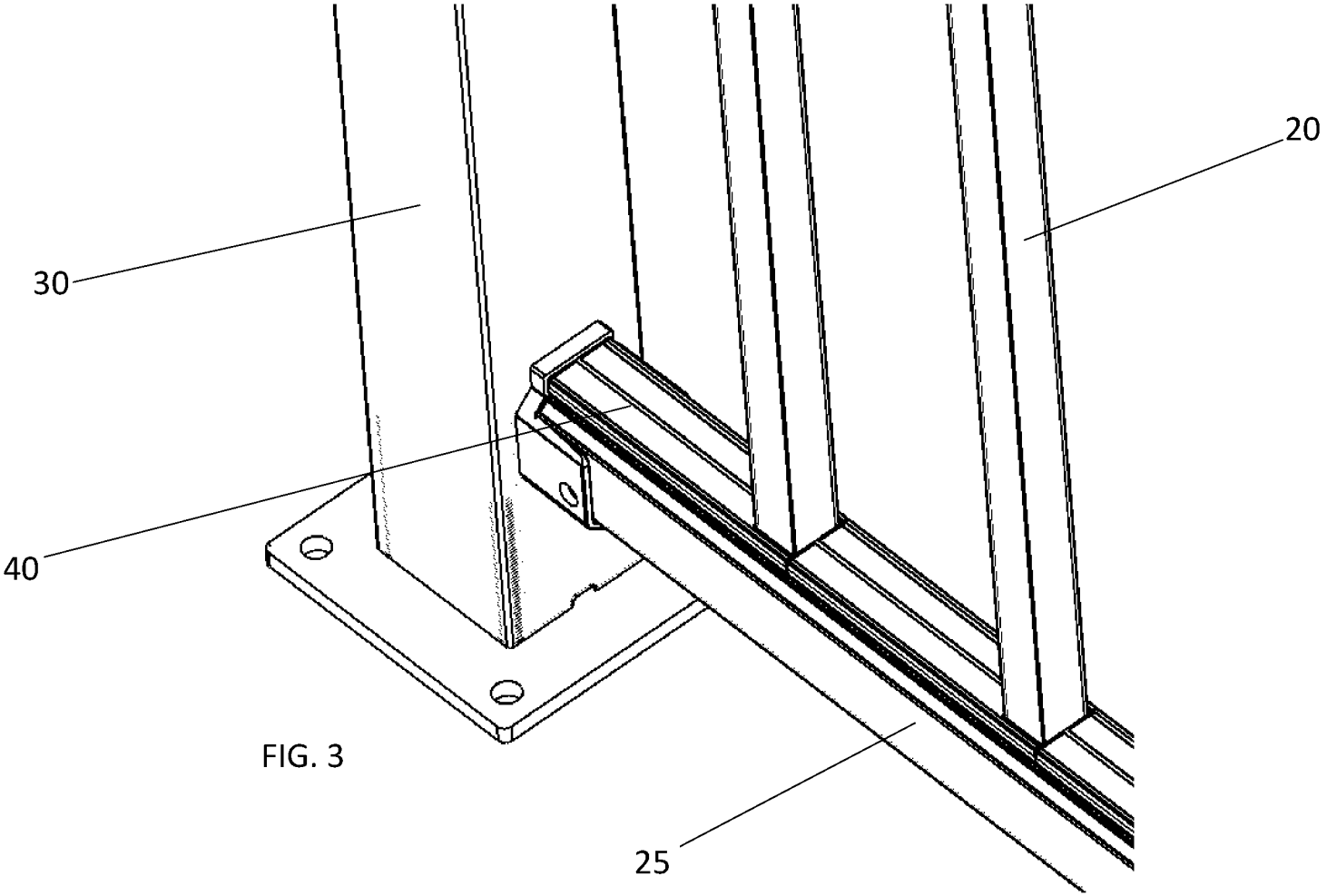
FIG. 3 is a perspective view of balusters connected to spacers and a bottom rail of the rail assembly, according to an embodiment of the present disclosure.
Figure 4:
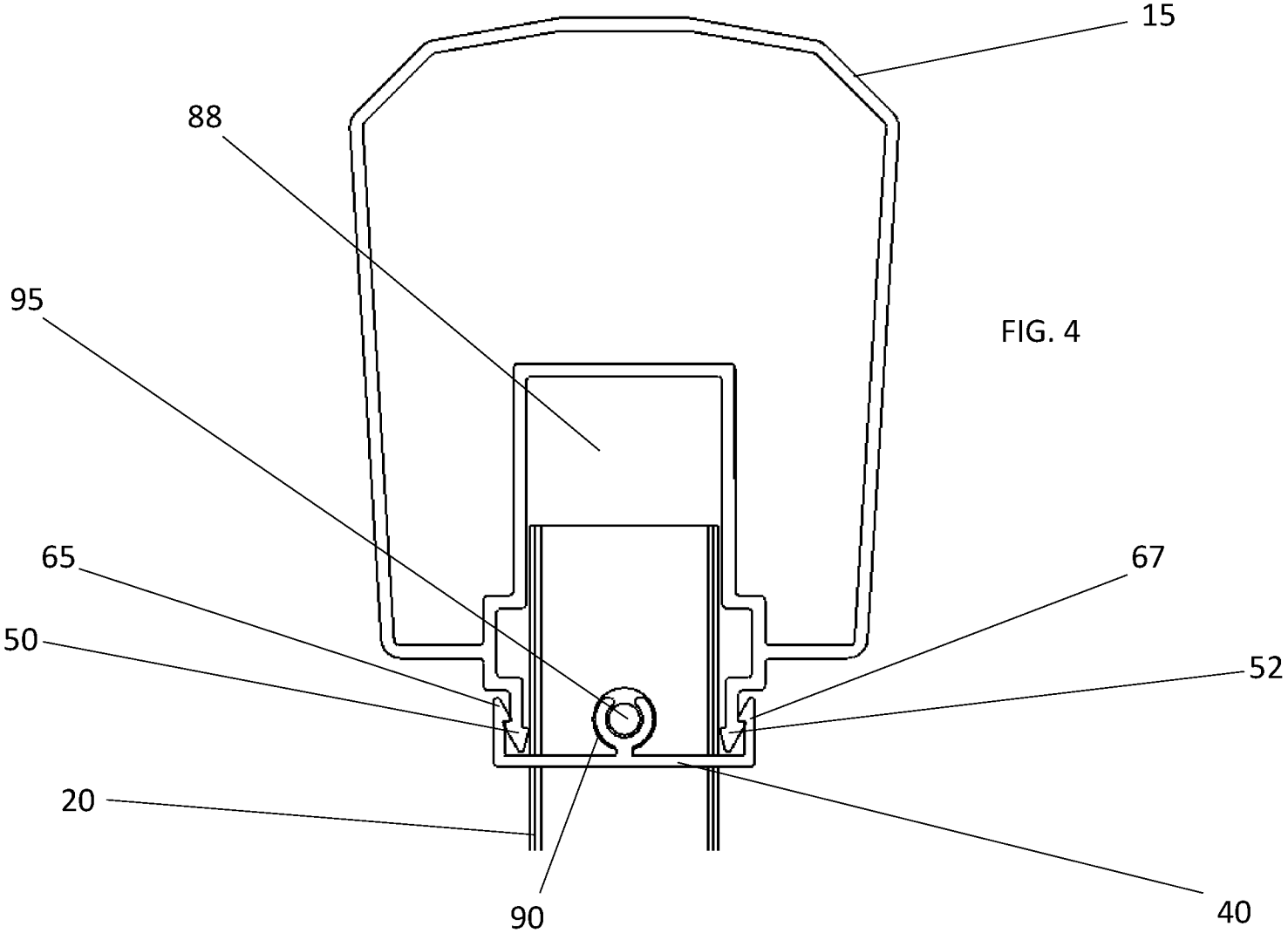
FIG. 4 is a cross-sectional front view of a baluster connected to a spacer and a top rail of the rail assembly, according to an embodiment of the present disclosure.
Figure 4A:
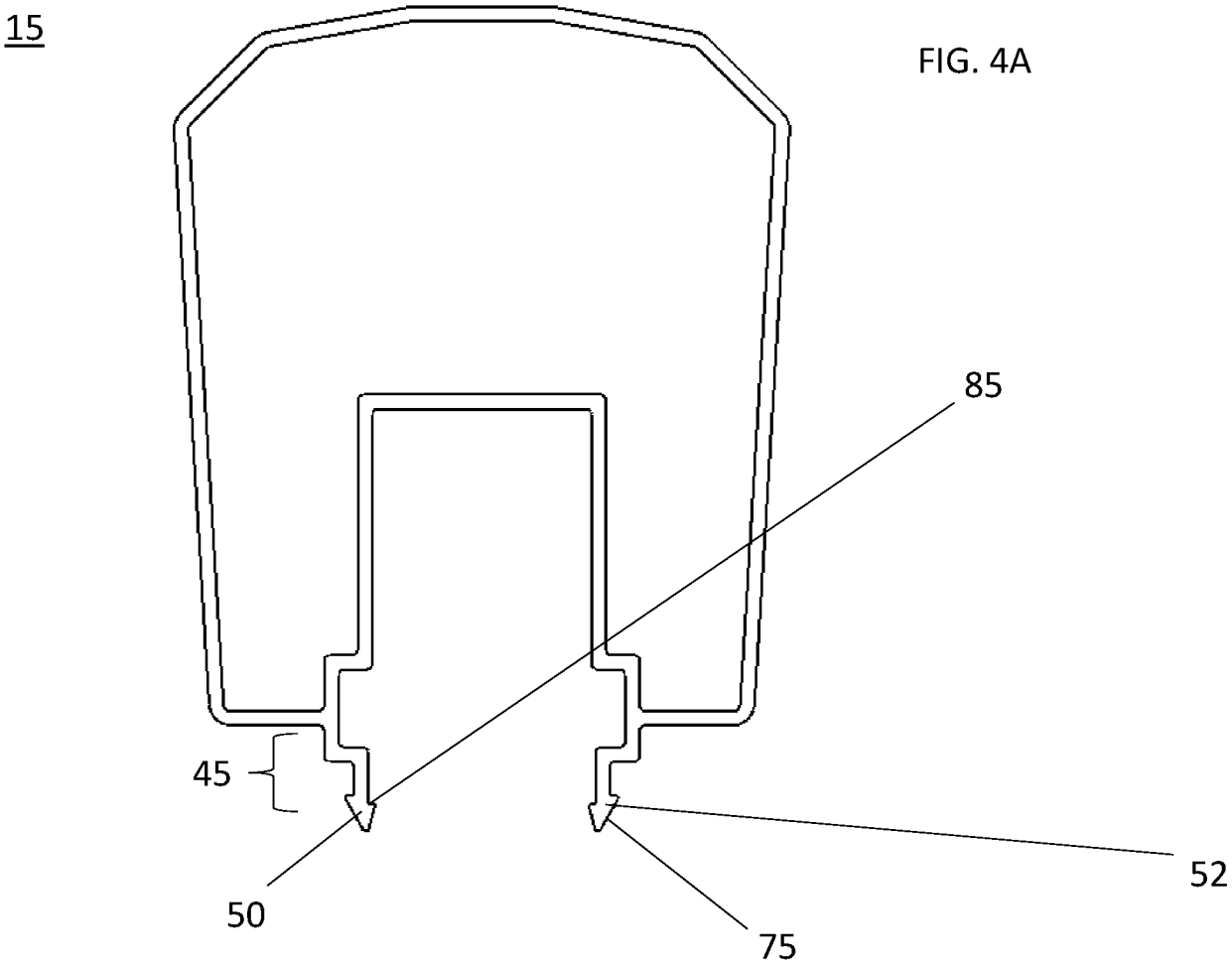
FIG. 4A is a cross-sectional front view of the top rail of the rail assembly, according to an embodiment of the present disclosure.
Figure 5:
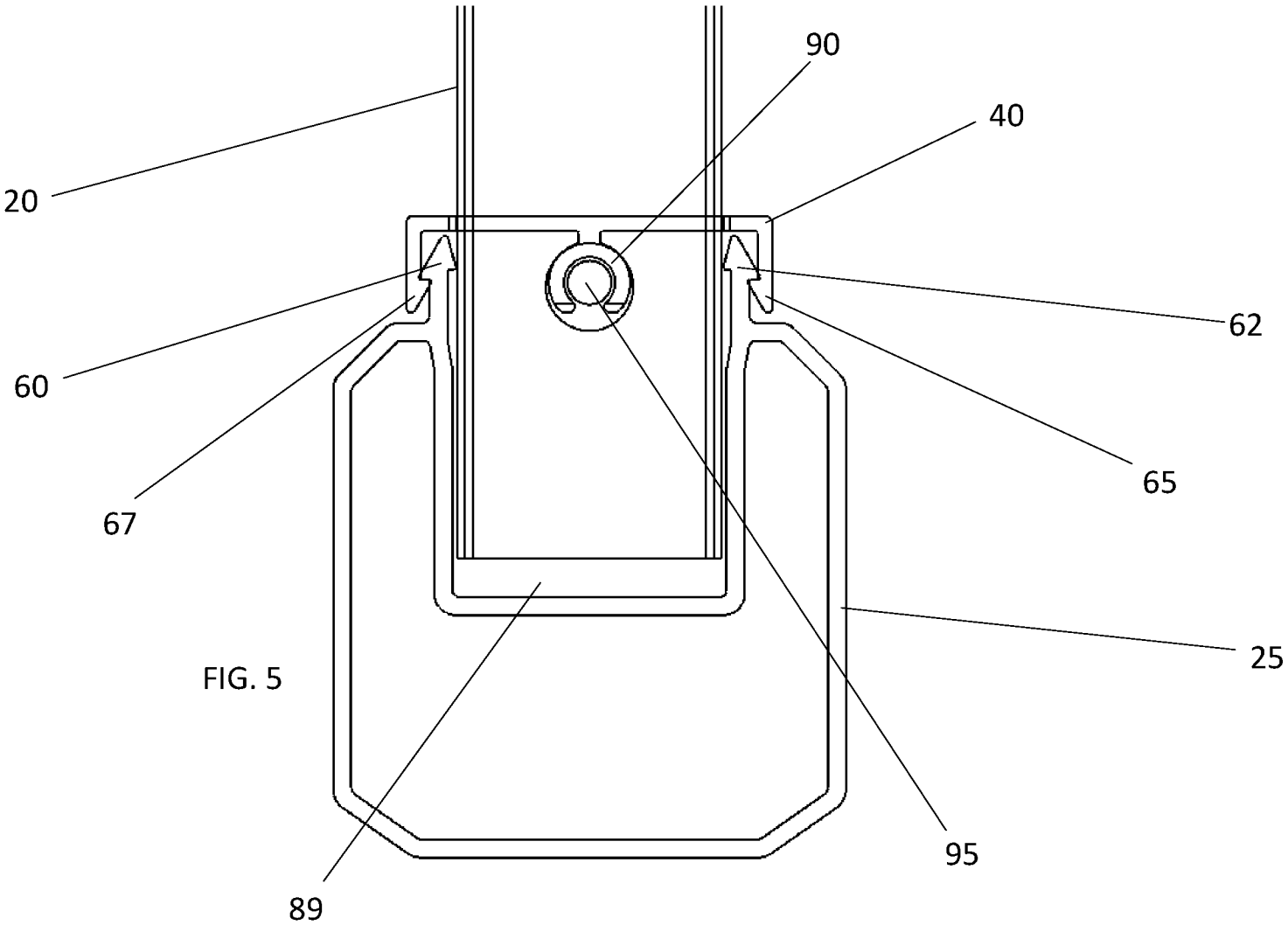
FIG. 5 is a cross-sectional front view of a baluster connected to a spacer and a bottom rail of the rail assembly, according to an embodiment of the present disclosure.
Figure 5A:
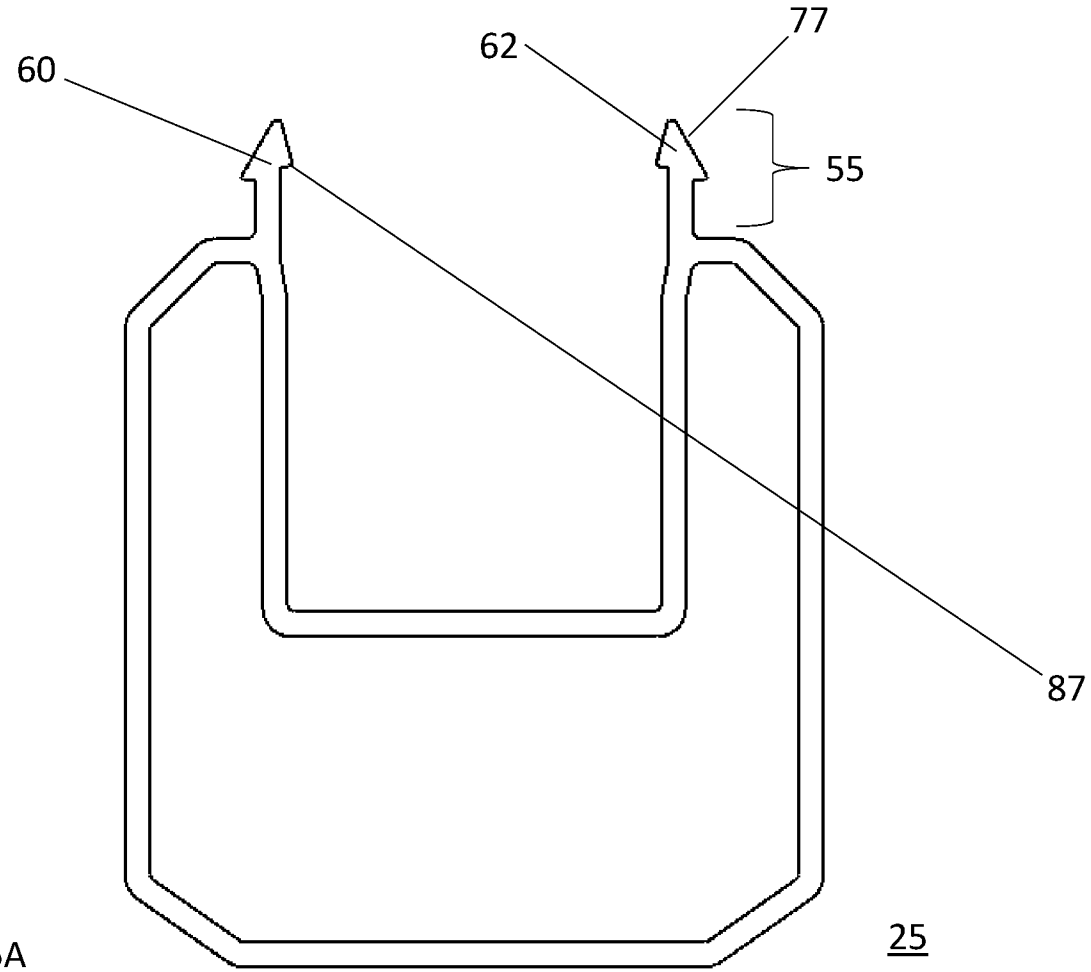
FIG. 5A is a cross-sectional front view of the bottom rail of the rail assembly, according to an embodiment of the present disclosure.
Figure 6:
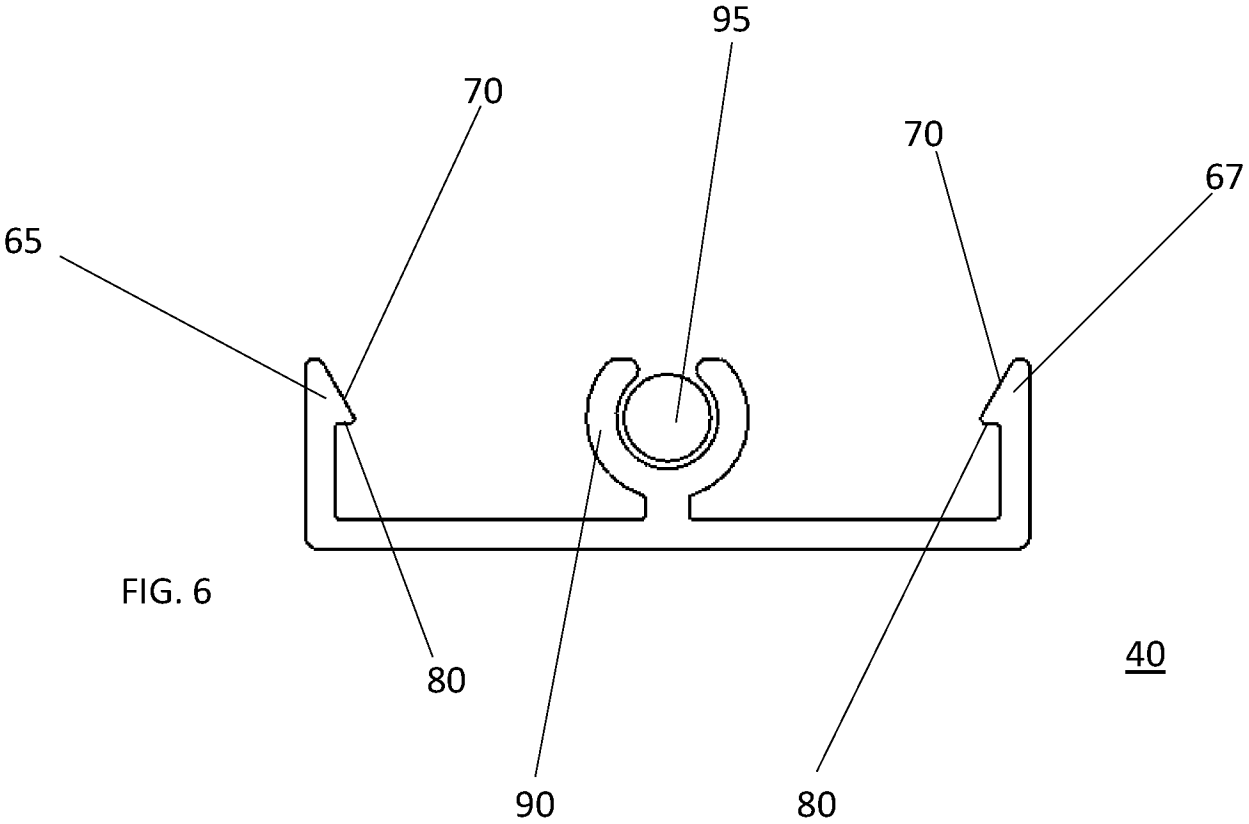
FIG. 6 is a front cross-sectional view of a spacer and a rod of the rail assembly, according to an embodiment of the present disclosure.
Figure 6A:
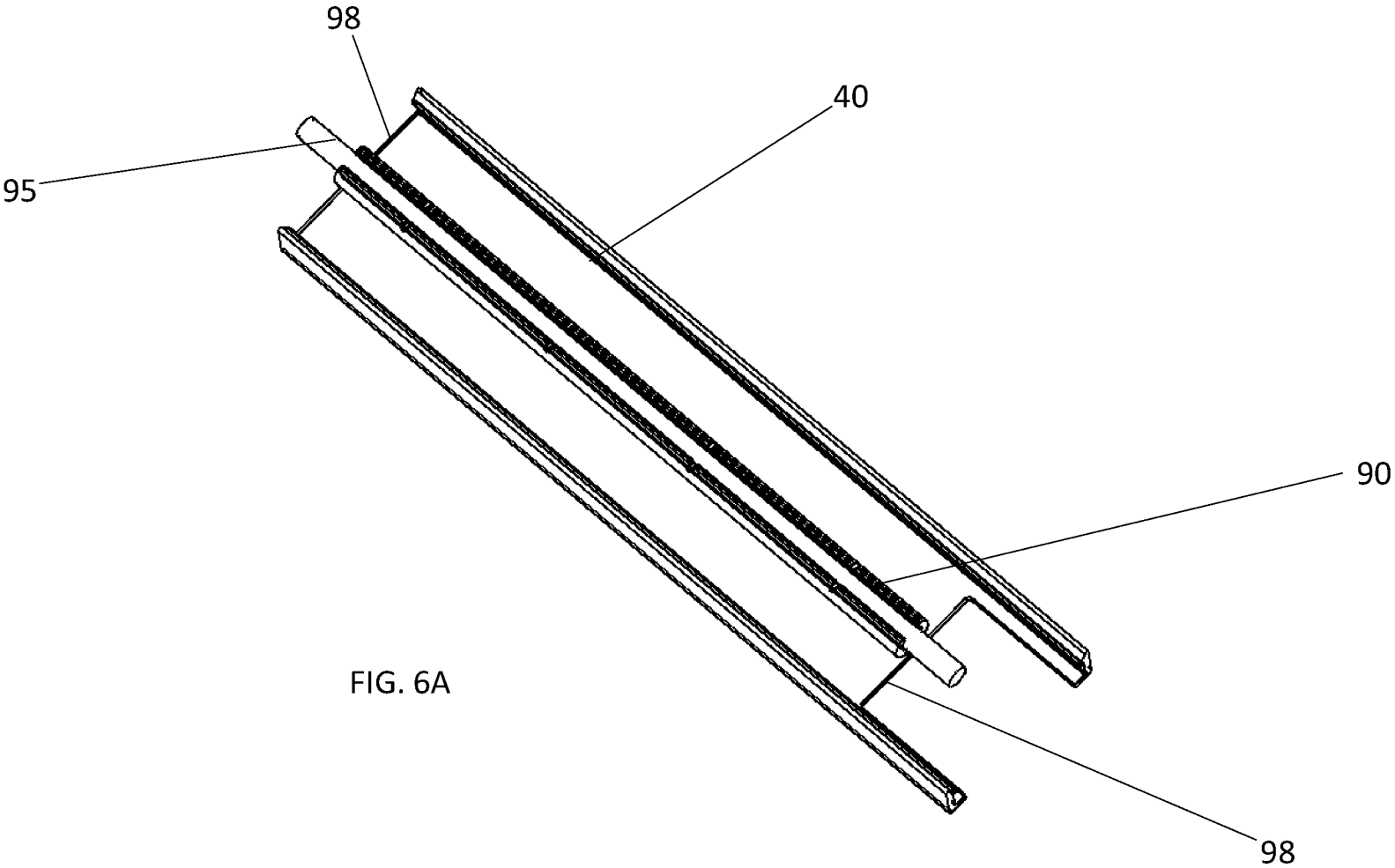
FIG. 6A is a perspective view of a spacer and a rod of the rail assembly, according to an embodiment of the present disclosure.

With reference to FIGS. 1, 2 and 3 and according to an embodiment of the present disclosure, a rail assembly 10 is shown preferably comprised of a top rail 15, at least one baluster 20 and a bottom rail 25. The top and bottom rails 15, 25 are separated by two posts 30, 32, the posts 30, 32 being anchored into the ground or floor for supporting the rail assembly 10. The balusters 20 are secured in between the top and bottom rails 15, 25 by means of spacers 40. In turn, the spacers 40 are connected to the top and bottom rails 15, 25 by a snap-fit connection that will be further described below.

With reference to FIGS. 4, 4A, 5, 5A, 6 and 6A, the connection in between the balusters 20, the top and bottom rails 15, 25 and the spacers 40 is shown in greater detail. Specifically, the top rail 15 is further comprised of a top connector 45, the top connector 45 further comprising first and second top locking members 50, 52. Meanwhile, the bottom rail 25 is further comprised of a bottom connector 55, the bottom connector 55 further comprising first and second bottom locking members 60, 62. Together, the top and bottom connectors 45, 55 are configured to mate with the spacers 40. Indeed, with specific reference to FIGS. 4 and 5, spacers 40 are shown connected and secured to the top and bottom rails 15, 25. The spacers 40 are further comprised of first and second mating arms 65, 67. The first and second mating arms 65, 67 each have a sloped inner surface 70 that slides onto the sloped outer surfaces 75, 77 of the top and bottom rails 15, 25, respectively. To connect the spacers 40 to the top and bottom rails 15, 25, the sloped inner surface 70 of the spacers 40 contact the sloped outer surfaces 75, 77 of either one of the top or bottom rails 15, 25 respectively. By applying continued force onto the spacer 40, its sloped inner surface 70 slides along the sloped outer surface 75 of the top rail 15 or the sloped outer surface 77 of the bottom rail 25, until a point as specifically shown in FIGS. 4 and 5. At this moment, the base 80 of the spacer 40 latches onto the corresponding top or bottom base 85, 87 of the top or bottom rail 15, 25, respectively. Once secured to one another, the spacers 40 are secured to the top or bottom rails 15, 25 and can only move longitudinally along either of the top or bottom rails 15, 25. A worker skilled in the art will appreciate that the upper and lower ends of the balusters 20 are positioned within cavities 88, 89 of the top and bottom rails 15, 25, respectively. The spacers 40 are further comprised of a central member 90 that shaped as an open-ended circle. Within the central member 90 is an aluminum rod 95 that is configured to lock into corresponding locking apertures (not shown) of the balusters 20. A worker skilled in the art would appreciate that although a rod is shown, any other member, including but not limited to a protrusion, nipple, screw, dowel, etc could also be used, provided that they are the correct size to fit into the locking apertures and sufficiently strong not to break under stress. With specific reference to FIG. 6A, it is shown that the rod 95 extends beyond each inner edge 98 of the spacer 40 to be able to penetrate the locking apertures of both adjacent balusters 20. A worker skilled in the art would appreciate that it is necessary for the rod 95 to extend beyond at least one inner edge 98 of the spacer to connect into the locking aperture (not shown) of the baluster 20. In a preferred embodiment, each end of the rod 95 extends into the locking apertures (not shown) of the baluster 20 for increased stability.

Figure 7:
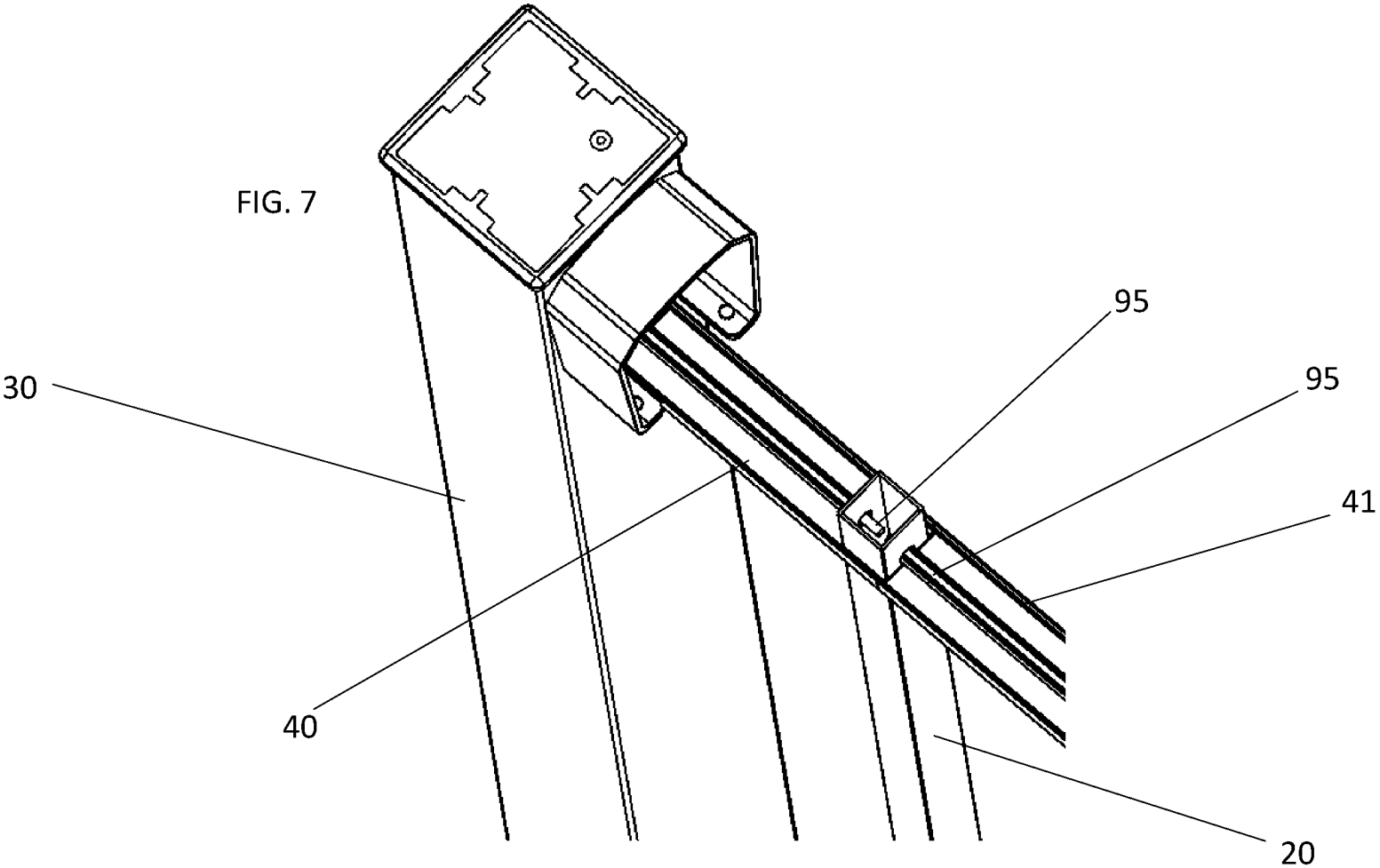
FIG. 7 is a perspective view of spacers connected to balusters by means of rods of a rail assembly, according to an embodiment of the present disclosure.
Figure 8:
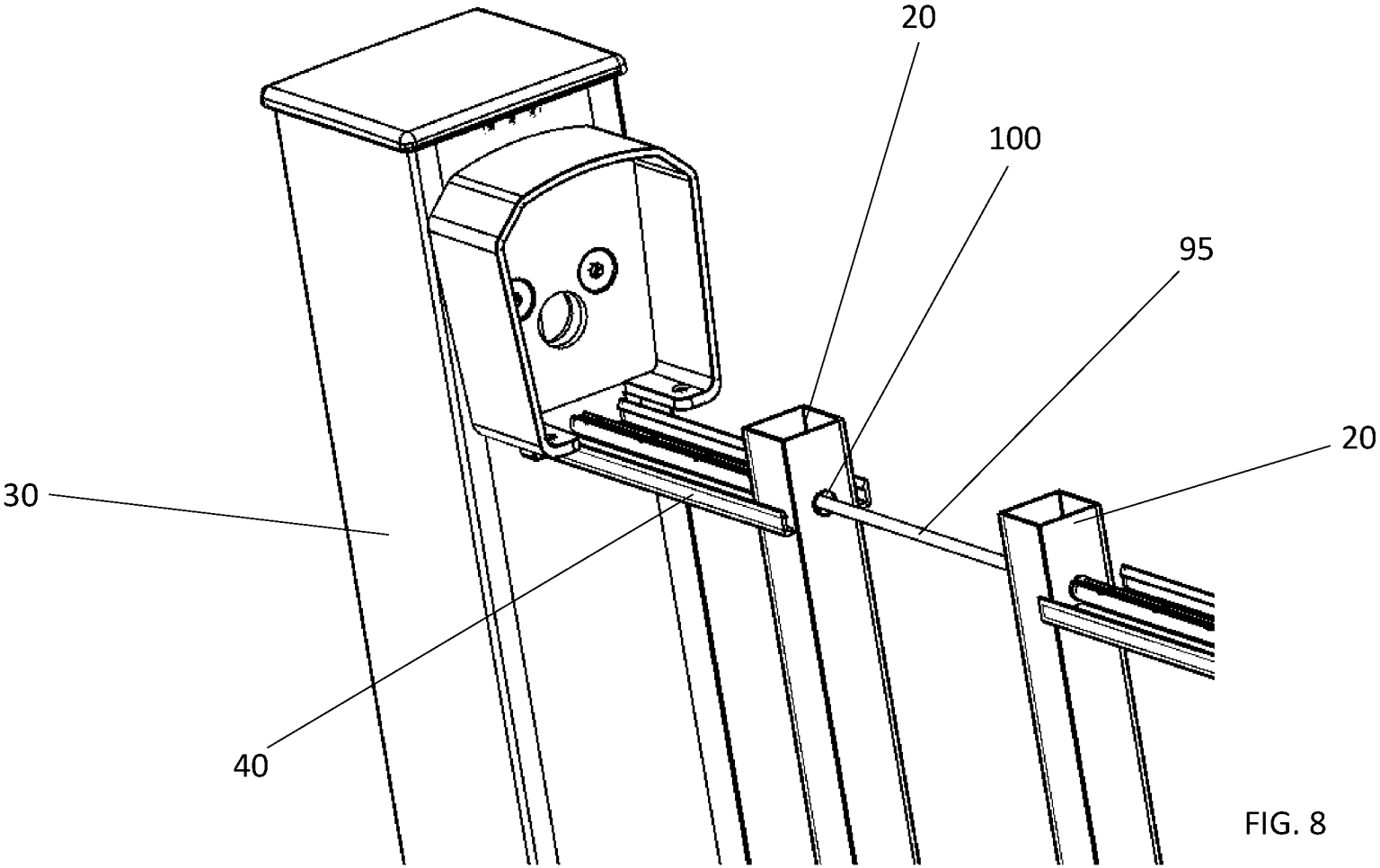
FIG. 8 is another perspective view of spacers connected to balusters by means of rods of a rail assembly, according to an embodiment of the present disclosure.

With reference to FIGS. 7 and 8 and according to an embodiment of the present disclosure, the spacers 40 are shown secured to one of the balusters 20. To connect the spacers 40 to the balusters 20, the rod 95 of the spacer 40 is inserted within the locking aperture 100 of the baluster 20. A second spacer 41 is positioned on the opposite side of the baluster 20 and has another rod 95 to be inserted within the locking aperture 100 of the baluster 20, thus securing the baluster 20 between a pair of adjacent spacers 40.

With reference to FIGS. 1, 4, 4A, 5, 5A, 6 and 8 and according to an embodiment of the present disclosure, to assemble the rail assembly 10, the first step is to align the sloped inner surfaces 70 of the spacer 40 with either one of the corresponding sloped outer surfaces 75, 77 of the top or bottom rails 15, 25, respectively. The second step is to apply a force onto the spacer 40 such that the sloped inner surface 70 slides along one of the sloped outer surfaces 75, 77, until the base 80 of the spacer latches onto the corresponding top or bottom base 85, 87 of the top or bottom rail 15, 25, respectively. In a third step, the rod 95 of the spacer 40 is aligned with and inserted into a corresponding locking aperture 100 of the baluster 20. Alternatively, in a first step the rod 95 of the spacer 40 can be aligned with and inserted into the locking aperture 100 of the baluster 20. In an alternative second step, and the sloped inner surfaces 70 of the spacer 40 are aligned with either one of the corresponding sloped outer surfaces 75, 77 of the top or bottom rails 15, 25, respectively. The alternative third step is to apply a force onto the spacer 40 such that the sloped inner surface 70 slides along one of the sloped outer surfaces 75, 77, until the base 80 of the spacer latches onto the corresponding top or bottom base 85, 87 of the top or bottom rail 15, 25, respectively. Either one of the first to third steps is repeated for the opposing and adjacent spacer 40 located on either the top and bottom rails 15, 25. In a fourth step, the next spacer 40 is snap-fit onto one of the top or bottom rail 15, 25. Then, by sliding the spacers 40 longitudinally along the top and bottom rails 15, 25, the rods 95 of the other spacers 40 are inserted into the corresponding locking apertures 100 of the balusters 20. At this moment, the baluster 20 is secured in between the top and bottom rails 15, 25 and in between pairs of adjacent spacers 40. The process is repeated for every other baluster 20 in the rail assembly 10, until the rail assembly 10 reaches the required length, that being the length of the top or bottom rails 15, 25.

Figure 9:
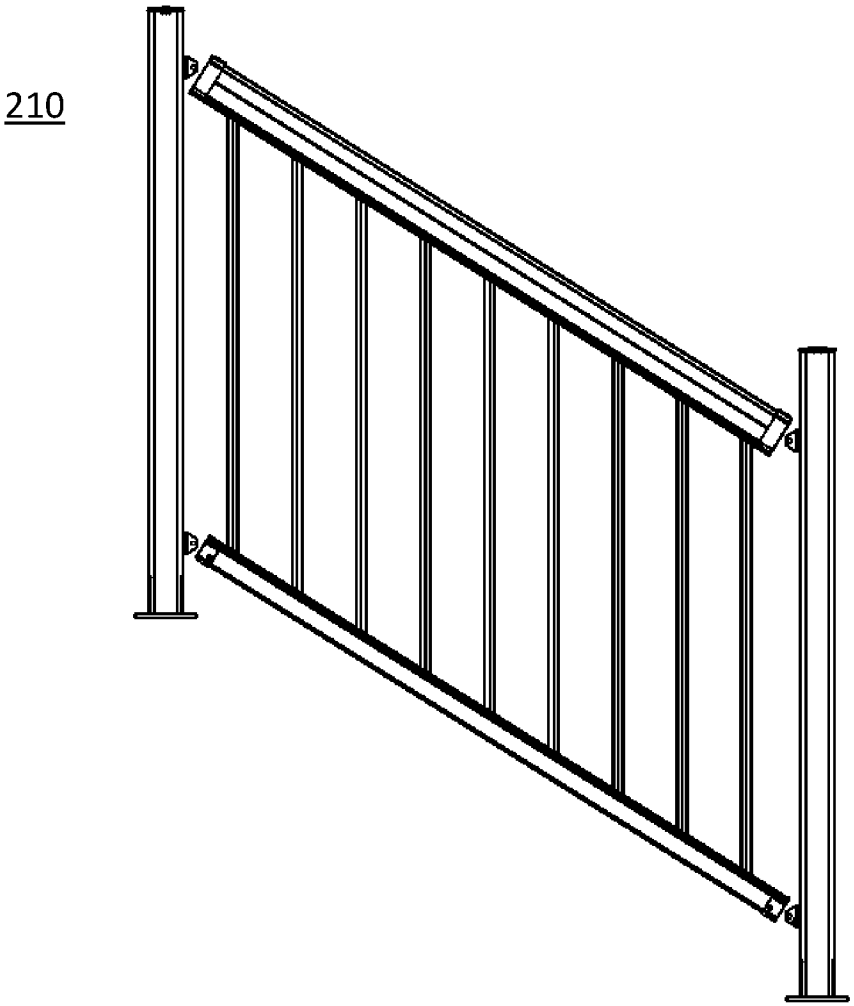
FIG. 9 is a front view of a rail assembly according to another embodiment of the present disclosure.
Figure 10A:
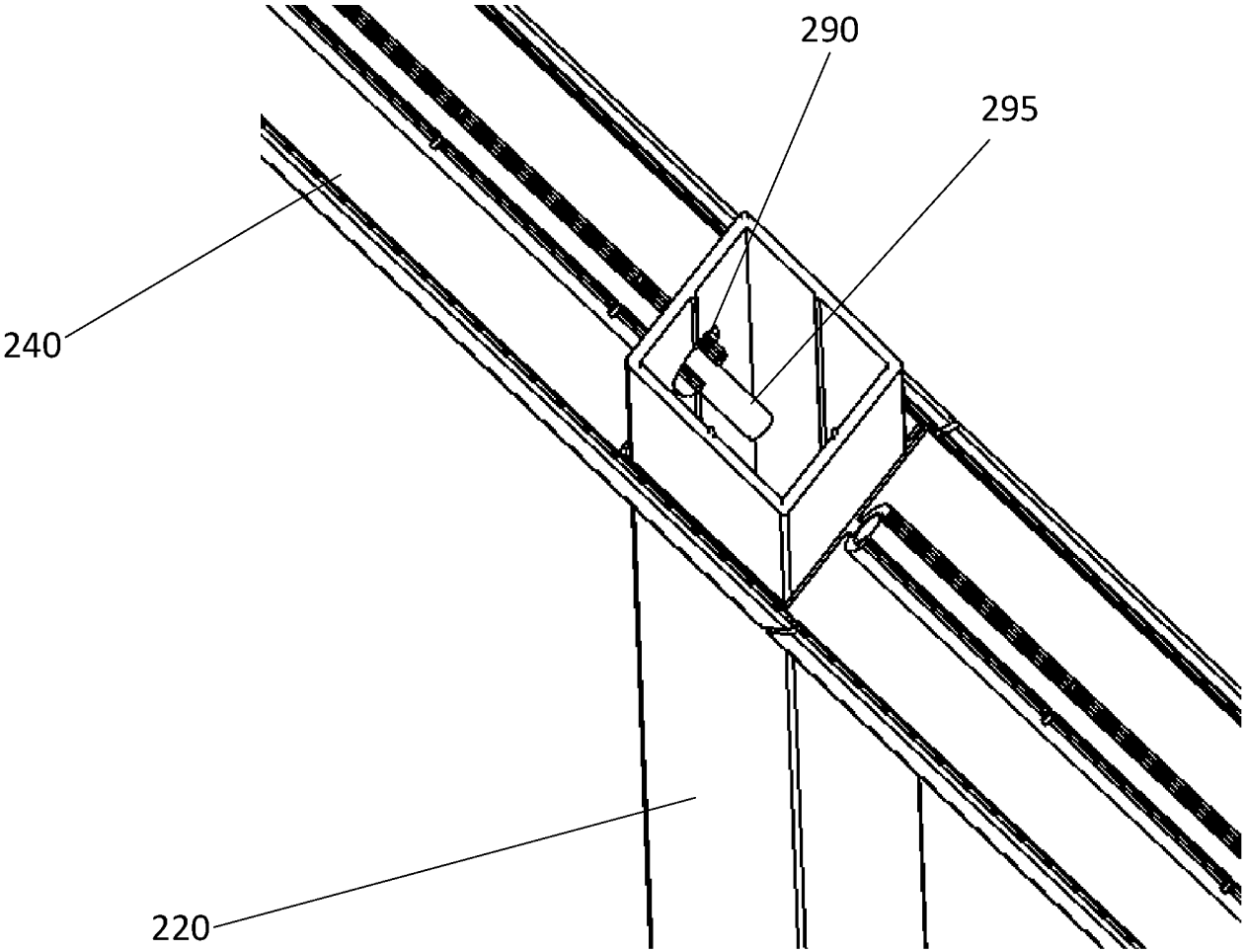
FIG. 10A is a perspective view of spacers connected to a baluster by means of a rod of a rail assembly, according to another embodiment of the present disclosure; and, FIG. 10B is a perspective view of a spacer and a rod of a rail assembly, according to another embodiment of the present disclosure.
Figure 10B:
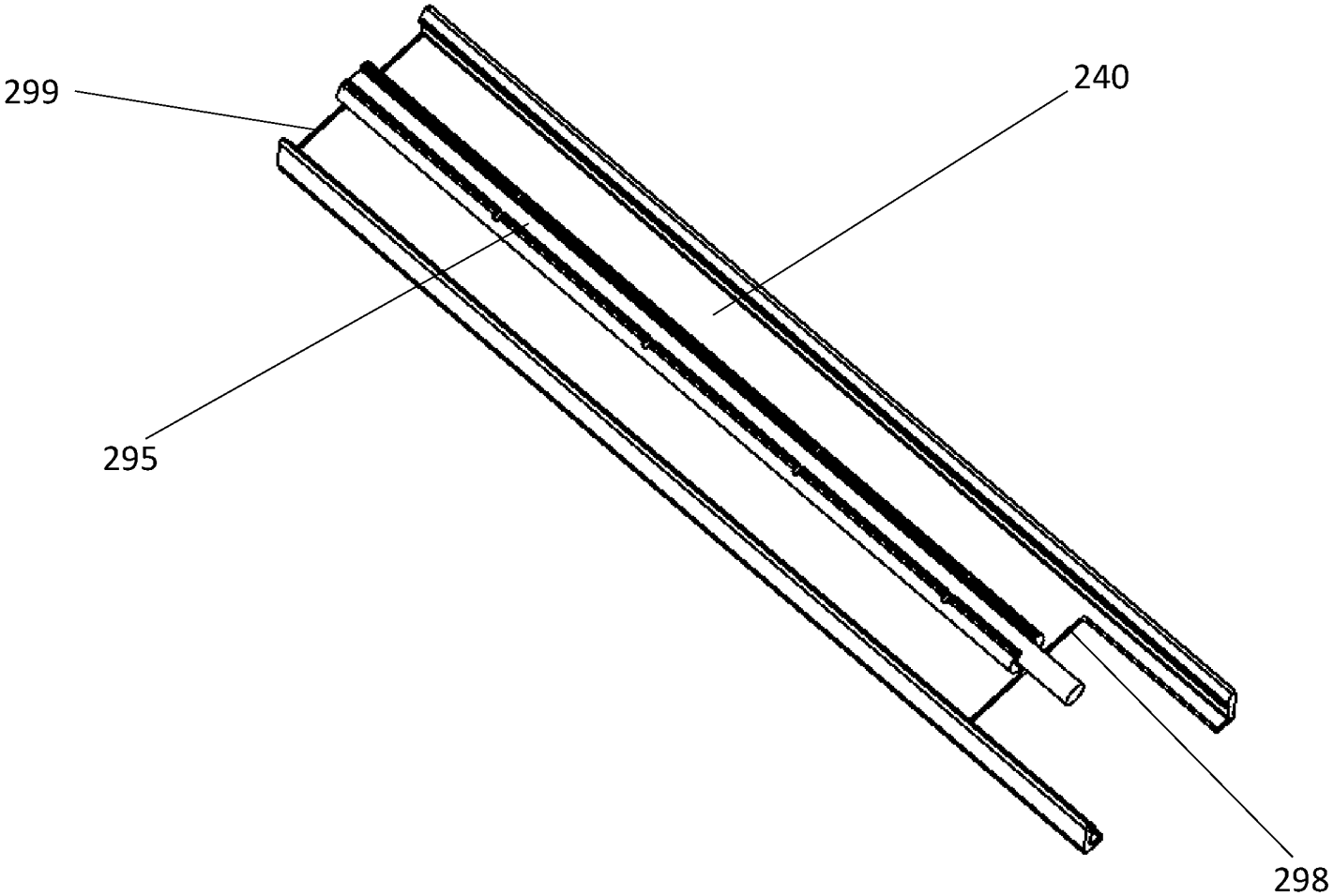

With reference to FIGS. 9, 10A and 10B and according to another embodiment of the present disclosure, the rail assembly 210 is shown for a stair application. A worker skilled in the art would appreciate that the main difference in rail assembly 210 (having regard to rail assembly 10) is that the rod 295 of the spacer 240 only extends beyond the inner edge 298 of the spacer 240 on one side. As specifically shown in FIG. 10B, the rod 295 is shown extending beyond the first inner edge 298 of the spacer 240 and does not extend beyond the second inner edge 299 of the spacer 240. As such, and due to the angle of insertion required in a stair application, the rod 295 is only inserted into a single corresponding locking aperture 290 on one side of the baluster 220.

Many modifications of the embodiments described herein as well as other embodiments may be evident to a person skilled in the art having the benefit of the teachings presented in the foregoing description and associated drawings. It is understood that these modifications and additional embodiments are captured within the scope of the contemplated disclosure which is not to be limited to the specific embodiment disclosed.

I claim:

1. A railing assembly comprising:

a top rail having a top connector positioned at a lower end of the top rail;

at least one baluster having a first end and a second end, the first end of the at least one baluster positioned within the top rail, wherein the first end and the second end each comprise a locking aperture;

a bottom rail connected to the second end of the at least one baluster, the bottom rail having a bottom connector positioned at an upper end of the bottom rail; and at least four spacers, wherein a first spacer and a second spacer of the at least four spacers are connected to the lower end of the top rail and are separated by the at least one baluster, wherein a third spacer and a fourth spacer of the at least four spacers are connected to the upper end of the bottom rail and are separated by the at least one baluster, wherein each of the at least four spacers comprises a rod configured to penetrate and lock into the locking apertures of the at least one baluster, wherein each of the rods extends from the at least one baluster to one of a post and another baluster.

2. The railing assembly of claim 1, wherein the top connector comprises a first top locking member and a second top locking member, and wherein the bottom connector comprises a first bottom locking member and a second bottom locking member.

3. The railing assembly of claim 1, wherein each of the at least four spacers further comprises a first mating arm and a second mating arm.

4. The railing assembly of claim 3, wherein each of the first mating arms and each of the second mating arms has a sloped inner surface extending from a flat base.

5. The railing assembly of claim 1, wherein the top connector and the bottom connector each comprise a cavity configured to receive at least one baluster.

6. The railing assembly of claim 1, wherein each of the at least four spacers further comprises a C-shaped central member, wherein each central member is configured to receive one of the rods.

7. The railing assembly of claim 1, wherein each of the rods extends beyond an inner edge of a corresponding spacer of the at least four spacers.

8. A method of assembling a railing assembly comprising:

applying a force onto a first spacer to snap-fit the first spacer onto a rail and inserting a first rod of the first spacer into a corresponding first locking aperture of a first baluster;

applying a force onto a second spacer to snap-fit the second spacer onto an opposite rail and inserting a second rod of the second spacer into a corresponding second locking aperture of the first baluster;

applying a force onto a third spacer to snap-fit the third spacer onto the rail and inserting a third rod of the third spacer into a corresponding third locking aperture of the first baluster;

applying a force onto a fourth spacer to snap-fit the fourth spacer onto the opposite rail and inserting a fourth rod of the fourth spacer into a corresponding fourth locking aperture of the first baluster; and, wherein the first rod, the second rod, the third rod and the fourth rod extend from the first baluster to one of a second baluster and a post, and repeating the preceding steps for n balusters for the length of the rail and the opposite rail, wherein n is an integer having a value of at least 1.

9. The method of claim 8, wherein each of the first spacer, the second spacer, the third spacer and the fourth spacer further comprises a first mating arm and a second mating arm.

10. The method of claim 9, wherein each of the first mating arms and each of the second mating arms has a sloped inner surface extending from a flat base.

11. The method of claim 8, wherein each of the first spacer, the second spacer, the third spacer and the fourth spacer further comprises a C-shaped central member, wherein each central member is configured to receive one of the rods.

* * * * *